United States Patent [19]

Signoretto

[11] Patent Number: 4,716,711

[45] Date of Patent: Jan. 5, 1988

[54] APPARATUS FOR CORRELATING WALLETS WITH PROCESSING ENVELOPES IN PHOTOGRAPHIC LABORATORIES

[75] Inventor: Roberto Signoretto, Venezia, Italy

[73] Assignee: Photo Engineering International S.r.l, Italy

[21] Appl. No.: 927,085

[22] Filed: Nov. 5, 1986

[30] Foreign Application Priority Data

Nov. 11, 1985 [IT] Italy ..... 84155 A/85

[51] Int. Cl.[4] ..... B65B 25/14

[52] U.S. Cl. ..... 53/460; 53/474; 53/520; 53/168; 53/266 A

[58] Field of Search ..... 53/460, 474, 168, 55, 53/206, 266 A, 266 C, 520

[56] References Cited

U.S. PATENT DOCUMENTS 4,115,981 9/1978 Hell ..... 53/55

4,574,692 3/1986 Wahli ..... 53/520 X

*Primary Examiner*—John Sipos

*Attorney, Agent, or Firm*—Charles W. Fallow; Martin P. Hoffman; Mitchell B. Wasson

[57] ABSTRACT

An apparatus for correlating wallets with processing envelopes in photographic laboratories comprising:

a dispenser (9) in which wallets (11) corresponding to the different customers are contained separately, means (5,7,8) for determining in accordance with the customer code read from the processing envelope (4), the extraction of a wallet (11) corresponding to that customer from the dispenser (9), means (13,14,15,16,17) for forming with the wallets (11) being extracted from said dispenser (9) a sequence corresponding to the sequence of processing envelopes (4) of that batch, and means for extracting one by one in the finishing station (21) the wallets (11) into which to insert the photographic material (28,29) corresponding to the processing envelopes (4) associated with said wallets (4).

10 Claims, 1 Drawing Figure

FIG. 1
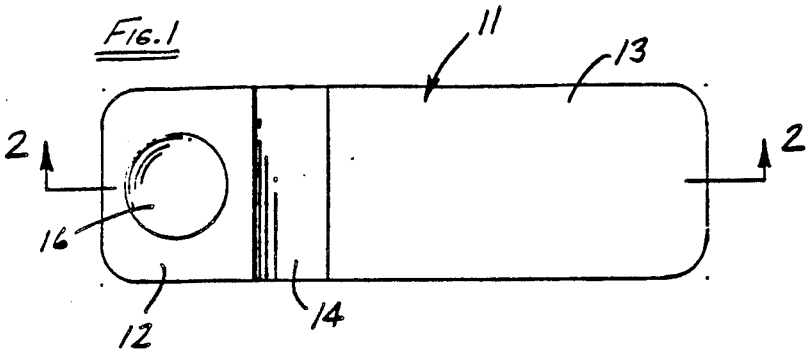
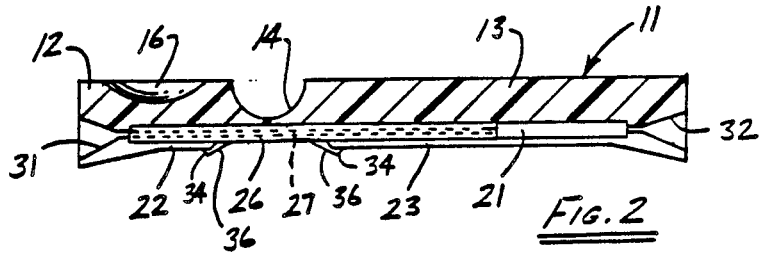
FIG. 2
FIG. 3
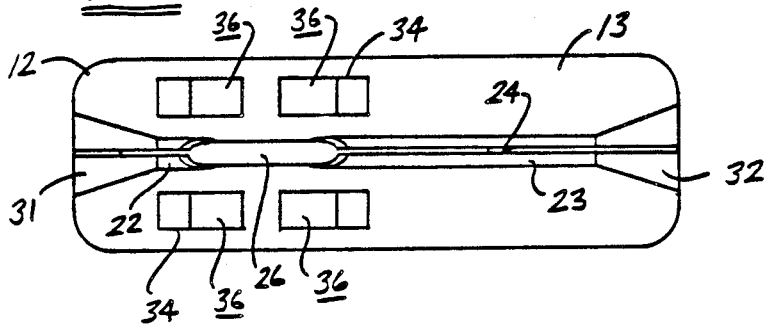
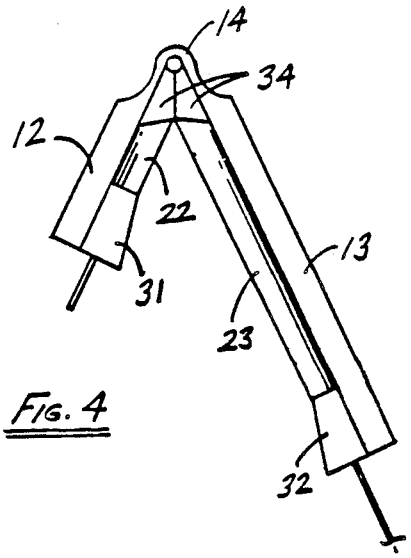
FIG. 4
FIG. 5
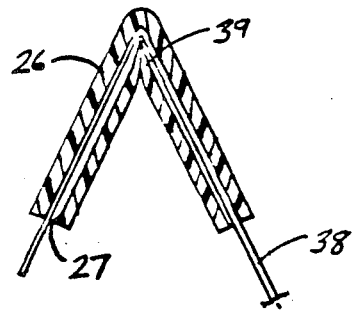

APPARATUS FOR CORRELATING WALLETS WITH PROCESSING ENVELOPES IN PHOTOGRAPHIC LABORATORIES

This invention relates to a method for correlating wallets with processing envelopes in photographic laboratories, and an apparatus for implementing the method.

Exposed films are currently developed and printed in photographic laboratories. In practice, the photographer customer hands the exposed photographic film to the shop for development and printing, and the shop delivers it to the photographic laboratory together with the films received from other photographer customers, each previously inserted into an envelope known as a "processing envelope". These films, together with the films originating from other shops, there undergo conventional developing and printing, and finally the negatives, out into portions, and the photographs obtained from these, are inserted into a two-compartment envelope known currently as a "wallet", which is then inserted into the original processing envelope for delivery to the distributor shop from which it originated.

For reasons mostly of a commercial nature, the shops or distribution centers often wish to personalize their service by using wallets distinguished by particular colours, quality and/or messages. However, this requirement contrasts with current requirement of photographic laboratories which, in order to limit the costs of their service, tend to use increasingly faster apparatus and increasingly more standardised procedures, which obviously require the use of uniform packaging. To exemplify the problem, it is apparent that using wallets obtained from a continuous module excludes the possibility of any differentiation related to the origin of the order.

The object of the invention is to solve this problem and to personalise the wallet used in photographic laboratories, but without influencing the operational speed of the conventional apparatus used in them.

The invention is based on the consideration that from the moment in which the processing envelope enters the photographic laboratory and is opened for removal of the film holder, to the moment in which it is again handled in the finishing station for receiving the wallet containing the negatives and prints, a time period of some hours passes, and this time period can be used for selecting the wallets conforming to distribution requirements.

According to the invention the problem of personalising wallets is solved by a method for correlating wallets with processing envelopes in photographic laboratories, characterised by:

identifying from the number present on each processing envelope the customer from which said envelope originates, withdrawing from a dispenser a wallet personalised for the customer thus identified, creating a batch of wallets disposed in the same sequence as the processing envelopes of that batch, and in the finishing station, inserting the photographic material corresponding to a determined processing envelope into the wallet associated with that processing envelope.

To implement the method heretofore described the invention provides for the use of an apparatus comprising:

a dispenser in which wallets corresponding to the different customers are contained separately, means for determining in accordance with the customer code read from the processing envelope, the extraction of a wallet corresponding to that customer from the dispenser, means for forming with the wallets being extracted from said dispenser a sequence corresponding to the sequence of processing envelopes of that batch, and means for extracting one by one in the finishing station the wallets into which to insert the photographic material corresponding to the processing envelopes associated with said wallets.

A preferred embodiment of the present invention is described in detail hereinafter by way of non-limiting example with reference to the accompanying drawing which shows a diagrammatic view partly in block form of an apparatus for implementing the method according to the invention.

The FIGURE shows the method and apparatus for correlating wallets with processing envelopes in photographic laboratories.

As can be seen from the FIGURE, the apparatus according to the invention comprises in the photographic laboratory arrival station 1, ie in the station in which the holder containing the film 3 is removed from the processing envelope 4, a reader 5 for the number 6 printed in bar code on the processing envelope 4. The reader 5 is connected by way of a decoder 7 to a microprocessor 8 controlling a wallet dispenser indicated overall by 9.

The dispenser 9 consists of a plurality of compartments 10, each of which houses a stack of wallets 11 personalised for a determined customer. Each compartment 10 comprise an inclined table 12 on which the stack of wallets 11 is placed with their front edge resting against an exit limiter 13 consisting essentially of a vertical stop member, the lower edge of which defines with an underlying roller 14 disposed in the table 12 an aperture just sufficient for passage of a single wallet 11. At the lower edge of the table 12 there is disposed a pair of rollers 15, which transfer the wallets 11 in the manner described hereinafter to between pairs of vertical belts 16 moving towards an underlying horizontal conveyor belt 17 on which groups of rollers 18 rest. The assembly consisting of the various compartments 10, the pairs of rollers 15 and the pairs of vertical belts 16 is formed in each a manner as to enable the wallets 11 extracted from each compartment 10 to reach, after travelling through a short vertical path, the conveyor belt 17 which discharges them at its front and so that they form an ordered stack. A control sensor 19, positioned in proximity to the pair of rollers 15 of each compartment 10, ensures the correct discharge of only one wallet 11 at a time, as will be apparent hereinafter, and a reader 20 positioned at the exit of the conveyor belt 17 checks the correct selection of the wallets.

Finally, in the finishing station 21 in addition to the store 22 for the stacked processing envelopes 4 there are also provided a further store 23 for the stacked wallets 11, and a pair of readers 24 and 25 which carry out a final check on the number 6 written in bar code on each processing envelope 4 and the number 26 also written in bar code on the corresponding wallet 11.

The operation of the apparatus according to the invention is as follows: initially, a number 26 uniquely related to that part of the number 6 present on each processing envelope 4 which identifies the distributor customer is printed on each wallet 11, which is personalised for each distributor customer. The various wallets thus differentiated are then disposed in the various compartments 10 of the dispenser 9, which is controlled by the microprocessor 8 which associates the customer code read from the processing envelope 4 with the identifying number 26 of the corresponding wallet 11, to feed to the relative compartment 10 a command for withdrawing one of these wallets. Withdrawal takes place in the following manner. When the microprocessor 8 determines from which compartment 10 a wallet 11 is to be withdrawn, it causes the corresponding roller 14 to operate in order to withdraw a wallet from below the limiter 13. The wallet 11, after being gripped by the pair of rollers 15, then passes in front of the sensor 19 which automatically halts the roller 14 to prevent withdrawal of further wallets. All the pairs of belts 16 lying between that particular compartment 10 and the conveyor belt 17 are then simultaneously operated to transfer the wallet 11 to the stack formation zone. The reader 20, provided at the exit end of the conveyor belt 17, has the double purpose of halting the belt 17 and the pairs of belts 16, and of checking that the number 26 effectively present on the selected wallet 11 corresponds to the customer number read by the reader 5 and then decoded by the decoder 7 and transmitted by the microprocessor 8 to a comparator circuit 27.

As the processing envelopes 4 become stacked in an ordered manner at the inlet station 1, a corresponding stack of wallets 11 disposed in the same sequence is formed.

The two stacks of processing envelopes 4 and wallets 11 are then transferred without undergoing alteration in their arrangement to the finishing station 21, where the photographic material consisting of the negatives 28 and prints 29 originating from a determined distributor customer is inserted into a wallet 11 personalised for that particular distributor customer, and the whole is then inserted into that processing envelope 4 from which the film holder 2 was originally removed. However before this insertion takes place the number 26 read by the reader 25 from that particular wallet 11 is compared with the number 6 read by the reader 24, and if these do not correspond the operating cycle of the apparatus is halted and an optical and/or accustic alarm 30 is activated.

What is claimed is:

1. A method for correlating wallets with processing envelopes in photographic laboratories, characterised by:

identifying from the number (6) present on each processing envelope (4) the customer from which said envelope originates, withdrawing from a dispenser (9) a wallet (11) personalised for the customer thus identified, creating a batch of wallets (11) disposed in the same sequence as the processing envelopes (4) of that batch, and in the finishing station (21), inserting the photographic material (28,29) correesponding to a determined processing envelope (4) into the wallet (11) associated with that processing envelope.

2. A method as claimed in claim 1, characterised by causing, on the basis of the number (6) read from the processing envelope (4), a wallet marked with a number (26) written in machine-readable code and uniquely related to said number (6) to be extracted from the dispenser (9), but checking correspondence between the number (6) read from the processing envelope (4) and the number (26) read from the wallet (11) before finally withdrawing said wallet (11) for forming the ordered sequence.

3. A method as claimed in claim 1, characterised by checking in the finishing station correspondence between said wallet (11) and the original processing envelope (4) before inserting the photographic material (28,29) into the wallet (11).

4. An apparatus for correlating wallets with processing envelopes in photographic laboratories, comprising:

a dispenser (9) in which wallets (11) corresponding to the different customers are contained separately, means (5,7,8) for extracting in accordance with the customer code read from the processing envelope (4) a wallet (11) corresponding to that customer from the dispenser (9).

means (13,14,15,16,17) for forming with the wallets (11) being extracted from said dispenser (9) a batch disposed in a sequence corresponding to the sequence of processing envelopes (4) of that batch, and means for extracting one by one in the finishing station (21) the wallets (11) into which to insert the photographic material (28,29) corresponding to the processing envelopes (4) associated with said wallets (4).

5. An apparatus as claimed in claim 4 characterised in that the dispenser (9) comprises:

a plurality of compartments (10) for containing the different wallets (11) personalised for the various customers, means for extracting from the prechosen compartment (10) a wallet (11) corresponding to the customer whose code has been previously read from the processing envelope (4), means (15,16,17) for conveying each wallet (11) from its corresponding pertaining compartment (10) to a stacking zone.

6. An apparatus as claimed in claim 5, characterised in that the dispenser (9) comprises a plurality of compartments (10) disposed in several rows and/or in several columns, each compartment being linked, by way of at least one pair of belts (16), to a common conveyor belt (17) for transferring the wallets (11) received from said pair of belts (16) to the formation zone for the ordered sequence.

7. An apparatus as claimed in claim 5 characterised in that each compartment (10) comprises an inclined table (12) on which a stack of wallets (11) is rested, an extractor (14) for the lower wallet of the stack, a limiter (13) facing said extractor (14) to prevent passage of more than one wallet at a time, and at least one pair of rollers (15) which transfer each wallet (11) from said inclined table (12) to said pair of belts (16).

8. An apparatus as claimed in claim 7, characterised in that for each compartment (10) there is provided, downstream of the pair of rollers (15), a sensor (19) which on passage of a wallet (11) halts the operation of the extractor member (14).

9. An apparatus as claimed in claim 4, characterised by comprising a reader (20) for a number written in machine-readable code on each wallet (11) and related to the code of the customer to whom said wallet refers, said reader (20) being disposed at the exit of the dispenser (9) and being connected, together with the means which control the extraction of the wallet (11), to a comparator (27) for checking that the correct selection has taken place.

10. An apparatus as claimed in claim 4, characterised by comprising in the finishing station (21) a store (22) for the processing envelopes (4) arranged in a determined sequence, a store (23) for the corresponding wallets (11) arranged per customer in the same sequence, a reader (24) for the number (6) provided on each processing envelope (4), a reader (25) for the number (2) provided on each wallet (11), and means for checking correct correspondence between the two numbers before inserting the photographic material (28,29) into the wallet (11).

* * * * *

UNITED STATES PATENT AND TRADEMARK OFFICE

CERTIFICATE OF CORRECTION

PATENT NO. : 4,716,711

DATED : January 5, 1988

INVENTOR(S) : Roberto Signoretto

It is certified that error appears in the above-identified patent and that said Letters Patent is hereby corrected as shown below:

The title page should be deleted to appear as per attached title page.

The sheet of Drawing consisting of Figures 1-5 should be deleted to appear as per attached sheet.

Signed and Sealed this

Sixth Day of September, 1988

*Attest:*

DONALD J. QUIGG

*Attesting Officer*

*Commissioner of Patents and Trademarks*

United States Patent [19]

Signoretto

[11] Patent Number: 4,716,711

[45] Date of Patent: Jan. 5, 1988

[54] APPARATUS FOR CORRELATING WALLETS WITH PROCESSING ENVELOPES IN PHOTOGRAPHIC LABORATORIES

[75] Inventor: Roberto Signoretto, Venezia, Italy

[73] Assignee: Photo Engineering International S.r.l, Italy

[21] Appl. No.: 927,085

[22] Filed: Nov. 5, 1986

[30] Foreign Application Priority Data

Nov. 11, 1985 [IT] Italy ..... 84155 A/85

[51] Int. Cl.[4] ..... B65B 25/14

[52] U.S. Cl. ..... 53/460; 53/474; 53/520; 53/168; 53/266 A

[58] Field of Search ..... 53/460, 474, 168, 55, 53/206, 266 A, 266 C, 520

[56] References Cited

U.S. PATENT DOCUMENTS 4,115,981 9/1978 Hell ..... 53/55

4,574,692 3/1986 Wahli ..... 53/520 X

*Primary Examiner*—John Sipos

*Attorney, Agent, or Firm*—Charles W. Fallow; Martin P. Hoffman; Mitchell B. Wasson

[57] ABSTRACT

An apparatus for correlating wallets with processing envelopes in photographic laboratories comprising:

a dispenser (9) in which wallets (11) corresponding to the different customers are contained separately, means (5,7,8) for determining in accordance with the customer code read from the processing envelope (4), the extraction of a wallet (11) corresponding to that customer from the dispenser (9), means (13,14,15,16,17) for forming with the wallets (11) being extracted from said dispenser (9) a sequence corresponding to the sequence of processing envelopes (4) of that batch, and means for extracting one by one in the finishing station (21) the wallets (11) into which to insert the photographic material (28,29) corresponding to the processing envelopes (4) associated with said wallets (4).

10 Claims, 1 Drawing Figure

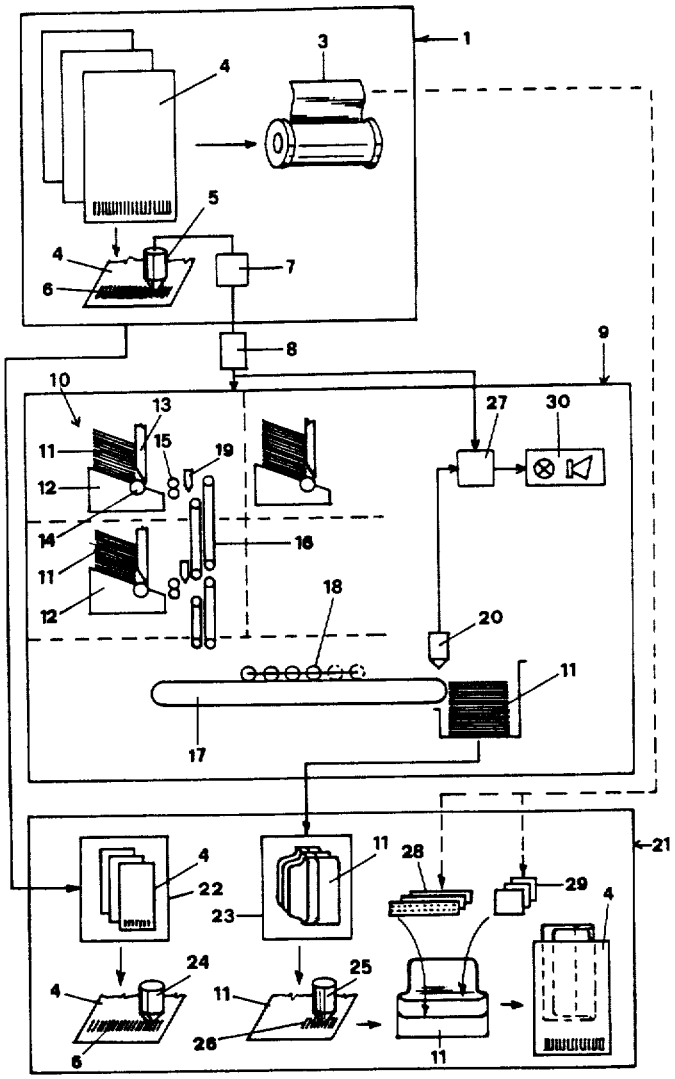

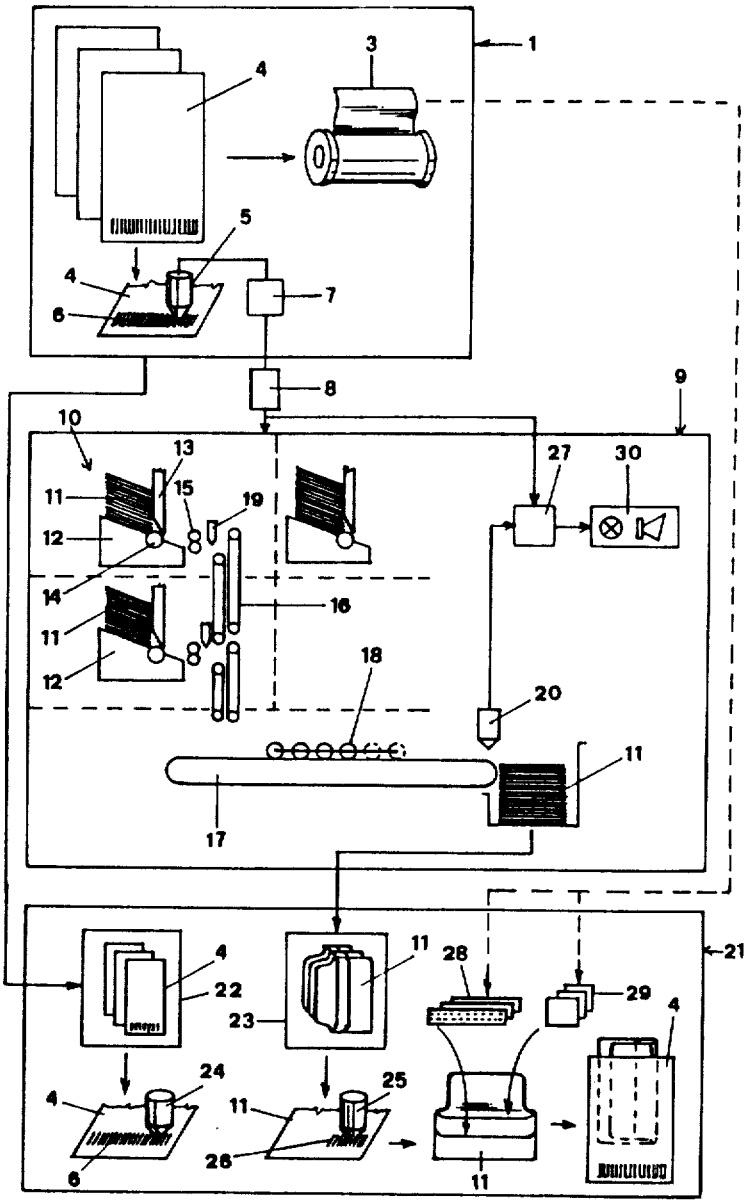

U.S. Patent Jan. 5, 1988 4,716,711